US006020566A

United States Patent [19]

Tsai

[11] Patent Number: 6,020,566

[45] Date of Patent: Feb. 1, 2000

[54] DEVICE OF BALANCING LEVER IN A MULTIPLICATIVE KEY

[75] Inventor: Huo-Lu Tsai, Taichung, Taiwan

[73] Assignee: Sunrex Technology Corp., Taiwan

[21] Appl. No.: 09/366,405

[22] Filed: Aug. 4, 1999

[30] Foreign Application Priority Data

Jan. 30, 1999 [TW] Taiwan ..... 88201594

[51] Int. Cl.[7] ..... H01H 13/70

[52] U.S. Cl. ..... 200/344

[58] Field of Search ..... 200/5 A, 517, 200/341, 344, 345; 400/490, 491, 491.2, 495, 495.1, 496

[56] References Cited

U.S. PATENT DOCUMENTS 4,709,128 11/1987 Odagawa ..... 200/340

5,669,723 9/1997 Chang ..... 400/496

5,823,325 10/1998 Lin ..... 200/344

5,941,373 8/1999 Cheng ..... 200/344

*Primary Examiner*—Michael Friedhofer

*Attorney, Agent, or Firm*—Connolly Bone Lodge & Hutz LLP

[57] ABSTRACT

A device of balancing lever in a multiplicative key used in a keyboard comprises a cap, a base with a pair of guiding elements, a bridge support, and a balancing lever. Each gliding element has a hole, both ends of the balancing lever are symmetrically bent upward at a suitable angle. The two ends of the balancing lever pass through the holes on the pair of guiding elements and are supported therein at fixed positions such that the cap is kept in a stable orientation when pressed on.

3 Claims, 3 Drawing Sheets

DEVICE OF BALANCING LEVER IN A MULTIPLICATIVE KEY

BACKGROUND OF THE INVENTION

1. Field of the Invention

The present invention relates to an improved device of balancing lever in a multiplicative key.

2. Description of Related Art

Conventional slim keyboards of notebook computers use keys, which each have a top, a base and a support device in between. The support device is shaped like a bridge or like a pair of scissors. Bridge-like supporting devices have been disclosed in Taiwan Patent Publication No. 282857 entitled "Key system for keyboard", No. 286794 entitled "Key switch", and No. 319438 entitled "Key switch with scissors-like lever element". The disclosed conventional systems are best suited for square-shaped keys of regular size. Elongated keys or so called multiplicative keys, e.g. the special keys SPACE, SHIFT, ENTER, require inserting a balancing lever. If no balancing lever is inserted, pressing an elongated key outside the center thereof will incline the key, and the key will not work properly. The balancing lever prevents tilting of the elongated key. But, during fast typing, conventional balancing levers are not able completely to prevent inclined elongated keys, which leads to extra noise and awkward typing. To improve on this shortcoming, Taiwan patent publication No. 346213 entitled "Improved enlarged key device" has disclosed a balancing lever which has two ends with an elastic tube each. The elastic tubes do not allow a horizontal movement of the top of the key against the base thereof. However, the device disclosed not only needs mounting additional elastic tubes, requiring extra cost and assembly time, but also is subject to fatigue. A worn elastic tube does not ensure the elongated key to be pressed down without tilting and is not easy to replace, such that typing remains impaired. To overcome this deficiency, the present invention further improves the structure and usability of elongated keys.

SUMMARY OF THE INVENTION

The present invention resides in that a device of balancing lever in a multiplicative key is provided and comprises a cap, having a lower side with a first pair of locking openings, a second pair of locking openings, a pair of gliding grooves, and a centrally located pressing part; a base, having two upward bent guiding openings, a carrier and a pair of guiding elements, which each have a hole, with a membrane switch and a spring mounted on said base; a bridge support, connecting said cap and said base, having a first plate with an upper edge and a lower edge and a second plate with an upper edge and a lower edge, said first and second plates turning against each other, with gliding rods, extending from said upper edge of said first plate, glidingly inserted in said pair of gliding grooves, locking elements on said upper edge of said second plate connected with said first pair of locking openings, gliding rods, extending from said lower edge of said first plate, pivotally connected with said two guiding openings, and locking elements on said lower edge of said second plate connected with said carrier; and a balancing lever, shaped like the letter U, with a middle part laid into said second pair of locking openings and two ends, which are symmetrically bent upward at a suitable angle, each of said ends passing through said hole on one of said pair of guiding elements and being supported therein at fixed positions.

Therefore, it is an object of the present invention to provide a device of balancing lever in a multiplicative key, which during fast typing does not allow a horizontal movement of the top of the key against the base thereof.

Another object of the present invention is to provide a device of balancing lever in a multipicative key with reduced noise during typing.

The present invention can be more fully understood by reference to the following description and accompanying drawings.

DETAILED DESCRIPTION OF THE PREFERRED EMBODIMENT

Figure 1:
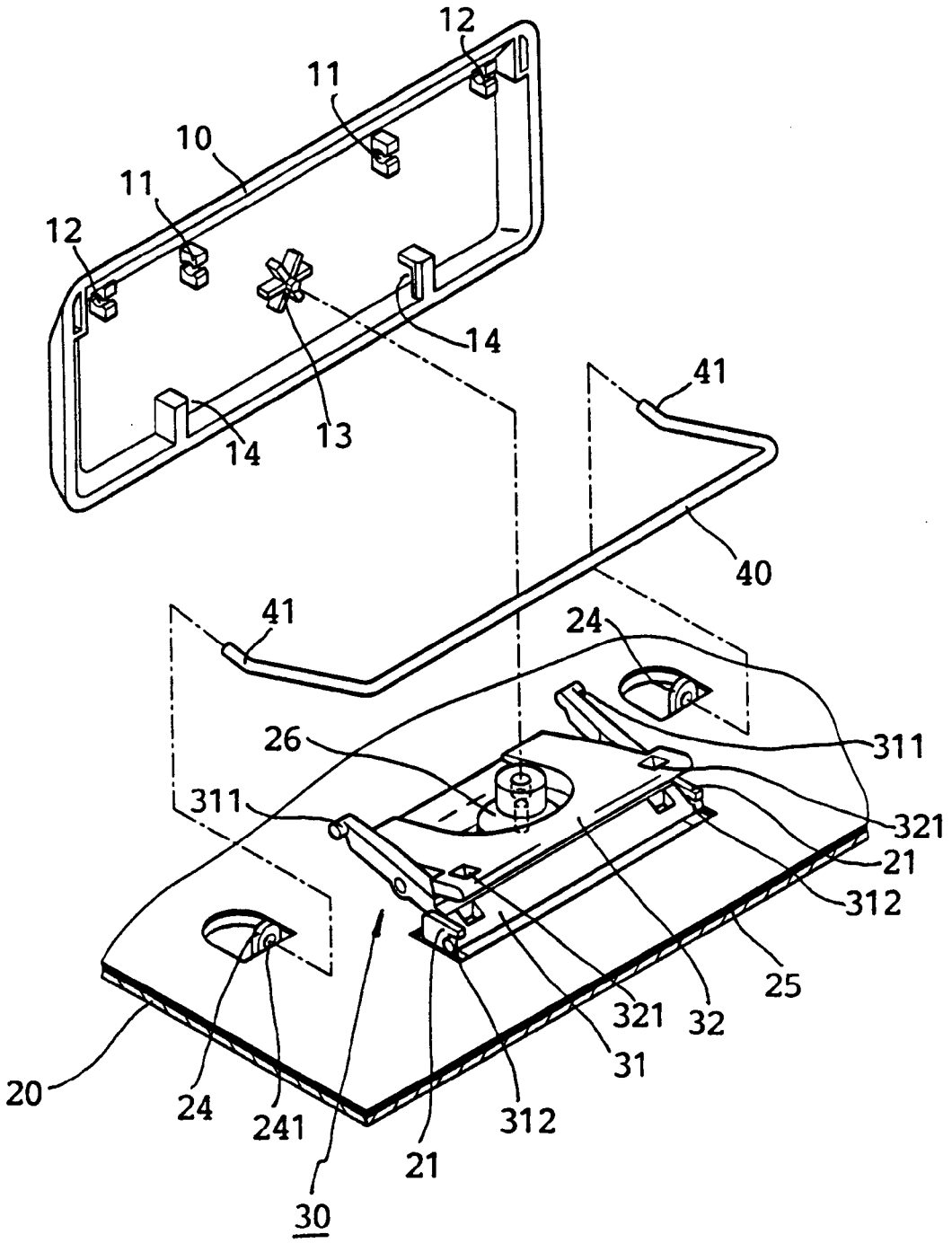
FIG. 1 is a perspective view of the device of balancing lever in a multiplicative key of the present invention when dissassembled.
Figure 2:
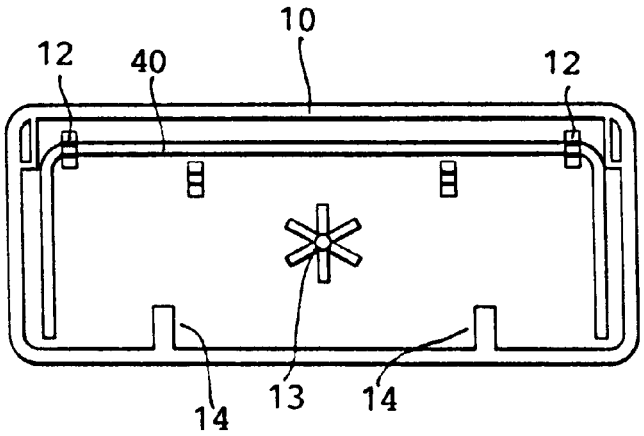
FIG. 2 is a schematic illustration of the assembly of the cap and the balancing lever of the present invention.
Figure 3:
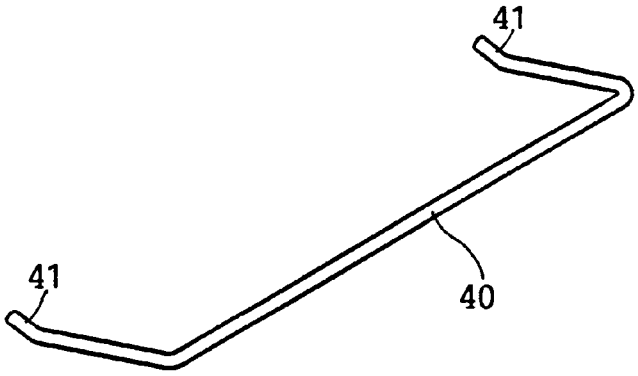
FIG. 3 is a schematic illustration of the balancing lever of the present invention.
Figure 4:
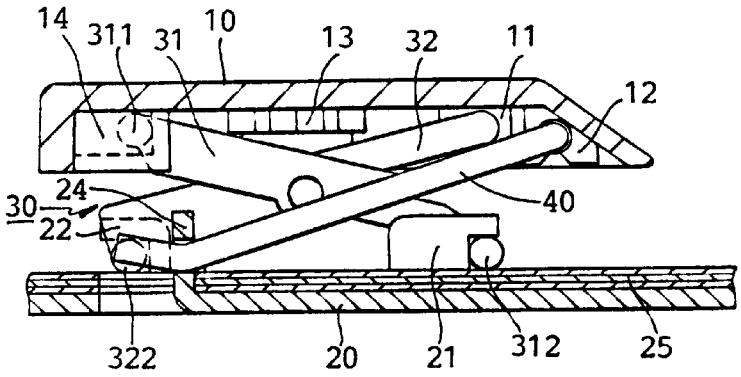
FIG. 4 is a side view of the device of balancing lever in a multi-sized key of the present invention.

As shown in all Figs., the device of balancing lever in a multiplicative key of the present invention comprises: a cap 10; a base; a bridge support 30, inserted between the cap 10 and the base 20; and a balancing lever 40. The bridge support 30 allows the cap 10 to move vertically against the base 20.

The cap 10 has a lower side with a first pair of locking openings 11, a second pair of locking openings 12, a pair of gliding grooves 14, and a centrally located pressing part 13. The base 20 has two upward bent guiding openings 21 and a carrier 22. The bridge support 30 on an upper edge thereof engages with the first pair of locking openings 11 and the pair of gliding grooves 14. The balancing lever 40 is inserted in the second pair of locking openings 12, having two bent ends 41.

The bridge support 30 consists of a first plate 31 and a second plate 32, turning against each other, each with upper and lower edges. Two gliding rods 311, extending from the upper edge of the first plate 31, are glidingly inserted in the pair of gliding grooves 14. Locking elements 321 on the upper edge of the second plate 32 are pivotally connected with the first pair of locking openings 11. Similarly, two gliding rods 312, extending from the lower edge of the first plate 31 are pivotally connected with the guiding openings 21. Locking elements 322 on the lower edge of the second plate 32 are connected with the carrier 22. Thus the bridge support 30 establishes a bridge-like connection between the cap 10 and the base 20.

Figure 5:
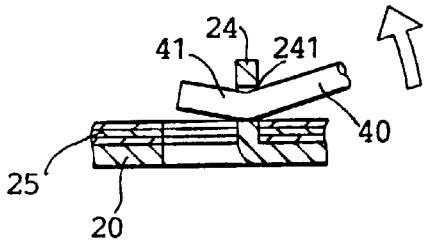
FIG. 5 is a schematic illustration of the movement of the present invention when the cap is released.
Figure 6:
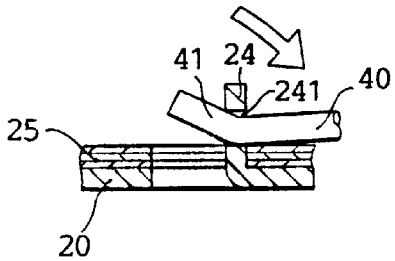
FIG. 6 is a schematic illustration of the movement of the present invention when the cap is pressed.

The two guiding openings 21 and the carrier 22 of the base 20 connect to the lower edges of the bridge support 30. The base 20 further comprises a pair of guiding elements 24, a membrane switch 25, and a spring 26. The spring 26 presses the pressing part 13 of the cap 10 upwards and thus provides a biased upward force when the key is pressed on the cap 10. Holes 241 are bored into each of the pair of guiding elements 24, accommodating the bent ends 41 of the balancing lever 40. As shown in FIGS. 5 and 6, turning the balancing lever 40 keeps the bent ends 41 thereof supported in the holes 241 at fixed positions.

The balancing lever 40 is a rod in the shape of the letter U with a middle part that is laid in the pair of second locking openings 12 on the lower side of the cap 10. The bent ends 41 pass through the holes 241, being supported on the guiding elements 24. Thus pressing on the enlarged key outside the center thereof does not result in an inclination of the enlarged key. Furthermore, during fast typing, a horizontal movement of the cap 10 against the base 20 is prevented by the bent ands 41 of the balancing lever 40 being supported in the holes 241 at fixed positions. No noise from tilting the key is generated. Therefore, the enlarged key with balancing lever device of the present invention provides an improved function.

While the invention has been described with reference to a preferred embodiment thereof, it is to be understood that modifications or variations may be easily made without departing from the spirit of this invention, which is defined by the appended claims.

What is claimed is:

1. A device of balancing lever in a multiplicative key, comprising:

a cap, having a lower side with a first pair of locking openings, a second pair of locking openings, a pair of gliding grooves, and a centrally located pressing part;

a base, having two upward bent guiding openings, a carrier and a pair of guiding elements, each of said guiding elements having a hole, with a membrane switch and a spring mounted on said base;

a bridge support, connecting said cap and said base, having a first plate with an upper edge and a lower edge and a second plate with an upper edge and a lower edge, said first and second plates turning against each other, with gliding rods, extending from said upper edge of said first plate, glidingly inserted in said pair of gliding grooves, locking elements on said upper edge of said second plate connected with said first pair of locking openings, gliding rods, extending from said lower edge of said first plate, pivotally connected with said two guiding openings, and locking elements on said lower edge of said second plate connected with said carrier; and a balancing lever, shaped like the letter U, with a middle part laid into said second pair of locking openings and two ends, said ends are symmetrically bent upward at a suitable angle, each of said ends passing through a respective one of said holes of said pair of guiding elements and being supported therein at fixed positions.

2. A device of balancing lever in a multiplicative key according to claim 1, wherein said bridge support has an upper edge, said first pair of locking openings and said pair of gliding grooves are pivotally connected with said upper edge of said bridge support, and said balancing lever is pivotally connected with said second pair of locking openings.

3. A device of balancing lever in a multiplicative key according to claim 1, wherein said spring presses on said pressing part, resulting in a biased force when said cap is pressed on.

* * * * *